US011476067B2

(12) United States Patent
Hoffmann

(10) Patent No.: US 11,476,067 B2
(45) Date of Patent: Oct. 18, 2022

(54) RELAY

(71) Applicant: Phoenix Contact GmbH & Co. KG, Blomberg (DE)

(72) Inventor: Ralf Hoffmann, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 85 days.

(21) Appl. No.: 17/049,903

(22) PCT Filed: Apr. 10, 2019

(86) PCT No.: PCT/EP2019/059088
§ 371 (c)(1),
(2) Date: Oct. 22, 2020

(87) PCT Pub. No.: WO2019/206635
PCT Pub. Date: Oct. 31, 2019

(65) Prior Publication Data

US 2021/0241988 A1 Aug. 5, 2021

(30) Foreign Application Priority Data

Apr. 24, 2018 (DE) ..... 10 2018 109 856.1

(51) Int. Cl.
*H01H 9/00* (2006.01)
*H01H 50/04* (2006.01)
(Continued)

(52) U.S. Cl.
CPC ..... *H01H 50/043* (2013.01); *H01H 50/18* (2013.01); *H01H 50/36* (2013.01); *H01H 2050/044* (2013.01)

(58) Field of Classification Search
CPC ..... H01H 50/043; H01H 50/18; H01H 50/36; H01H 2050/044; H01H 50/042; H01H 2050/046; H01H 2050/367; H01H 50/041
(Continued)

(56) References Cited

U.S. PATENT DOCUMENTS 4,053,858 A * 10/1977 Aidn ..... H01H 50/36 335/128
4,340,876 A * 7/1982 Dammert ..... H01H 50/26 335/274
(Continued)

FOREIGN PATENT DOCUMENTS

AT 410 855 B 8/2003
DE 2221702 A1 11/1973
(Continued)

*Primary Examiner* — Shawki S Ismail
*Assistant Examiner* — Lisa N Homza
(74) *Attorney, Agent, or Firm* — Holland & Hart LLP

(57) ABSTRACT

A relay includes an armature, a yoke configured to be electromagnetically coupled to the armature, and a bracket-shaped clamping spring. The armature lies at least partially flat on the yoke, and a receiving depression is partly formed in the armature. The bracket-shaped clamping spring surrounds the armature and the yoke on an end face such that the armature is fixed on the yoke. The bracket-shaped clamping spring has a first clamping limb arranged in the receiving depression of the armature, and a second clamping limb lying on the yoke. The first clamping limb has an angled tab which engages elastically into a recess formed in the receiving depression of the armature.

17 Claims, 12 Drawing Sheets

(51) Int. Cl.
*H01H 50/18* (2006.01)
*H01H 50/36* (2006.01)

(58) Field of Classification Search
USPC ..... 335/203
See application file for complete search history.

(56) References Cited

U.S. PATENT DOCUMENTS 4,346,359 A * 8/1982 Pirner ..... H01H 50/042 335/203
4,366,459 A * 12/1982 Vitola ..... H01H 51/12 335/203
4,456,896 A * 6/1984 Hayden ..... H01H 50/042 335/196
4,551,698 A * 11/1985 Aidn ..... H01H 51/2272 335/78
4,684,909 A * 8/1987 Dittmann ..... H01H 50/042 335/133
5,689,222 A * 11/1997 Schneider ..... H01H 50/36 335/78
2003/0034863 A1* 2/2003 Ono ..... H01H 51/20 335/128
2004/0227600 A1* 11/2004 Mikl ..... H01H 50/36 335/129
2004/0256151 A1* 12/2004 Wada ..... E21B 25/18 175/246
2005/0264280 A1* 12/2005 Shoji ..... G01D 5/145 324/207.11
2006/0139133 A1* 6/2006 Hoffmann ..... H01H 49/00 335/128
2007/0229203 A1* 10/2007 Mikl ..... H01H 51/2227 335/78
2008/0266039 A1* 10/2008 Mikl ..... H01H 50/36 335/282
2009/0231070 A1* 9/2009 Saruwatari ..... H01H 51/2272 335/179
2011/0120844 A1* 5/2011 Hoffmann ..... H01H 50/02 200/275
2016/0012993 A1* 1/2016 Sasaki ..... H01H 50/20 335/203
2016/0133413 A1* 5/2016 Bock ..... H01H 50/443 335/203
2016/0300673 A1* 10/2016 Yamagata ..... H01H 50/38
2016/0314921 A1* 10/2016 Aratani ..... H01H 3/001
2017/0092450 A1* 3/2017 Sunohara ..... H01H 50/44

FOREIGN PATENT DOCUMENTS

DE 102009047192 A1 5/2011
EP 2 187 418 A2 5/2010
EP 3 367 412 A1 8/2018

* cited by examiner

RELAY

CROSS-REFERENCE TO RELATED APPLICATIONS

The present application is the national phase entry under 35 U.S.C. 371 of International Patent Application No. PCT/EP2019/059088 by Hoffmann, entitled "RELAY," filed Apr. 10, 2019; and claims the benefit of German Patent Application No. 10 2018 109 856.1 by Hoffmann, entitled "RELAIS," filed Apr. 24, 2018, each of which is assigned to the assignee hereof and is incorporated by reference in its entirety.

FIELD OF THE DISCLOSURE

The disclosure relates to a relay with a reduced overall depth for use in terminal blocks, which in particular have a connection width less than or equal to 3.5 mm.

BACKGROUND

Electromagnetic switches, in particular relays, typically have a mechanical switching contact which can be switched by means of an electromagnet. A predetermined force usually has to be applied to switch the mechanical switch. For this purpose, the mechanical switch can be connected to an armature, which typically has a high magnetic permeability. The armature can be spring-coupled to the electromagnet so that when a current flows through the electromagnet, the armature is deflected by the electromagnet and when the current flow is switched off, the armature is pressed into the rest position and a bearing by means of a retaining spring.

With the mechanical switch, a minimum necessary switching force can be defined, which can limit a reduction in size of the armature-yoke arrangement, since the magnetic field generated by the yoke can be proportional to the size of the yoke and a magnetic force between the yoke and the armature among others can be proportional to the size of the armature. Furthermore, the installation space of the armature-yoke arrangement can be disadvantageously increased by the retaining spring, since the retaining spring can at least partially enclose the yoke and the armature. The retaining spring can be a flat spring that lies on the armature and on the yoke. To fasten the retaining spring, fastening devices for the retaining spring can be provided on the armature and/or on the yoke, which devices can further disadvantageously increase the installation space of the yoke-armature arrangement.

SUMMARY

It is the object of the present disclosure to provide a relay which realizes a more efficient form and arrangement of the electromechanical coupling, wherein in particular a reduced installation space of the relay can be achieved.

This object is achieved by the features of the independent claim. Advantageous examples are the subject of the dependent claims, the description and the accompanying figures.

The present disclosure is based on the knowledge that the above object can be achieved by a relay which has a depressed arrangement of a clamping spring for spring-loaded mounting of the armature on the yoke. The clamping spring is also adapted in such a way that a tension force can be transmitted to the yoke and to the armature via resilient clamping limbs, whereby a spring-loaded mounting of the clamping spring on the armature that is reduced in terms of installation space can be implemented by means of a wave-shaped bracket. In addition, the clamping spring is arranged in a receiving depression in the armature, so that when the clamping spring is fastened to the armature, the overall height of the armature can be unchanged.

According to a first aspect, the disclosure relates to a relay comprising an armature and a yoke which can be electromagnetically coupled to the armature, wherein the armature lies at least partially flat on the yoke, wherein a receiving depression is partly formed in the armature. Furthermore, the relay comprises a bracket-shaped clamping spring which surrounds the armature and the yoke on the end face in order to fix the armature on the yoke. The bracket-shaped clamping spring has a first clamping limb, which is arranged in the receiving depression, and a second clamping limb, which lies on the yoke. Furthermore, the first clamping limb has an angled tab which engages elastically in a recess formed in the receiving depression of the armature.

The relay according to the disclosure has the advantage that a narrow design of the relay can be realized, which does not exceed a terminal width of 3.5 mm or 3.0 mm, so that the relay can be used in a terminal block with a correspondingly narrow grid dimension. With the bracket-shaped clamping spring, the armature can be reset after an electromagnetic deflection of the armature relative to the yoke has been realized, so that a subsequent deflection is possible. The armature can be deflected in such a way that the armature and the yoke enclose an acute angle.

The armature can be ferromagnetic or paramagnetic, wherein a power efficiency of an electromagnetically induced relative movement of the armature with respect to the yoke can be proportional to the magnetic permeability of the armature. The higher the magnetic permeability of the armature, the lower the magnetic field strength that can be necessary for deflecting the armature. The smaller the magnetic field strength, the smaller the dimensions of the relay, in particular of the yoke and/or of the armature.

At least one electromagnetic coil can be arranged on the yoke, wherein the yoke can form a coil core. The yoke can be ferromagnetic and in particular be formed in one piece or from a composite plate in order to realize and/or improve a magnetic coupling by means of the magnetic field that can be generated by the electromagnetic coil and the armature. Furthermore, the yoke can be U-shaped, comprising an electromagnetic coil being arranged on each limb of the U-shaped yoke.

The armature and/or the coil can have a rectangular shape. In particular in the area of the bracket-shaped clamping spring, the armature and the yoke can be arranged congruently. The armature can rest on the yoke and at least partially cover both limbs of the U-shaped yoke.

The bracket-shaped clamping spring can be made from an elastic material, in particular from a metal, for example steel, aluminum or copper or their alloys, or a plastic, for example an elastomer, rubber or fiber-reinforced plastic. A pre-tensioning of the first clamping limb and/or the second clamping limb can be generated by means of a pre-tensioning form, in which in a tension-free state the respective clamping limb encloses a larger angle with the respective support surface than in a pre-tensioned state. The pre-tensioned state can be implemented by arranging the bracket-shaped clamping spring on the armature and on the yoke, the respective change in angle being achieved by a compressive force applied by the armature or yoke.

The angled tab can be stepped, in particular curved or wave-shaped. With this shape, the angled tab can implement a pre-tensioning of the first clamping limb, in particular if the angled tab has a step height which exceeds a structural depth of the recess. Accordingly, when the angled tab engages in the recess, the angled tab can be elastically deformed and a spring tension can be applied to it.

In one example, the armature has a web which at least partially bridges the recess and/or ends flush with the receiving depression.

This has the advantage that the bracket-shaped clamping spring can be secured against being removed and/or falling off the armature and/or the yoke. Furthermore, the bracket-shaped clamping spring can be stretched by a relative movement between the armature and the yoke. In particular in the case of an angular movement between the armature and the yoke, the angled tab can accordingly be lifted and possibly pressed out of the recess. The web can limit a movement of the angled tab, in particular parallel to the armature movement, so that the angled tab can be held in the recess by the web.

Furthermore, in a tension-free state the angled tab can have a less curved or straight shape than in a tensioned state. The tensioned state can be realized by engaging the angled tab in the recess, the angled tab being tensioned in such a way that the angled tab exerts a compressive force on the web. Accordingly, the angled tab can form a lever with which the first clamping limb can be pressed into the receiving depression.

In one example, the bracket-shaped clamping spring comprises a connecting plate which connects the first clamping limb to the second clamping limb, and wherein the connecting plate lies on an armature end face and/or on a yoke end face.

With a support of the connecting plate on the armature end face or the yoke end face, an installation space of the bracket-shaped clamping spring perpendicular to the armature end face or the yoke end face can be advantageously reduced. In particular, the armature end face and/or the yoke end face can have a depression for receiving the connecting plate. The connecting plate can protrude beyond the yoke in order to realize an angled connection of the second clamping limb to the yoke. In particular, the second clamping limb can enclose an acute angle with the connecting plate.

Furthermore, the angled tab can enclose an almost right angle with the connecting plate. The connection angle of the respective clamping limb to the connecting plate can vary with a relative movement between the armature and the yoke. Furthermore, the connecting plate can be materially connected to the first clamping limb and/or the second clamping limb and, for example, be formed in one piece with them.

The bracket-shaped clamping spring can form a bearing point of the armature on the yoke. A relative movement of the armature with respect to the yoke is advantageously equal to zero or almost zero in the event of an electromagnetic deflection of the armature by the yoke at the bearing point. A tilting movement of the armature relative to the yoke can realized and a lever effect can be maximized, which can be used to switch the mechanical switch.

In order to prevent a translational movement of the armature at the bearing point and/or to allow only a rotational movement, the connecting plate can be rigid in a longitudinal direction and can be flexible perpendicular to the longitudinal direction. With the rigid adaption of the connecting plate along the longitudinal direction, in particular an expansion with a change in length of the connecting plate can be prevented, so that the distance between the armature and the yoke can be constant at the bearing point. With a bending elastic adaptation of the connecting plate, a rotation of the armature around the bearing point can be realized. The connection plate can in particular be adapted to be flexible in relation to forces acting at connection points with the first clamping limb and/or the second clamping limb.

The connecting plate can have a curvature in the longitudinal direction in order to enable a rotation of the armature around the longitudinal direction of the connecting plate. Furthermore, the connecting plate can be adapted to be partly more flexible than the first clamping limb and/or the second clamping limb in order to realize an elastic, spring-loaded press connection of the first clamping limb to the armature and the second clamping limb to the yoke.

In one example, a receiving depth of the receiving depression is at least equal to or greater than a structural depth of the first clamping limb arranged in the receiving depression in order to arrange the bracket-shaped clamping spring on the armature side below a surface of the armature.

This has the advantage that the bracket-shaped clamping spring does not protrude beyond the surface of the armature in the region of the receiving depression. Thus, the armature can also have a flat surface with an inserted bracket-shaped clamping spring, so that in particular a structural height of the armature is flush with the surface. Accordingly, the height of the relay can be limited by the surface of the armature.

The receiving depression can extend up to the armature end face and/or can be opened laterally on one side or on both sides. The bracket-shaped clamping spring can be pushed onto the armature via the lateral opening of the receiving depression. In the case of a one-sided opening of the receiving depression, the closed side of the receiving depression can form a stop for sliding on the bracket-shaped clamping spring, so that an end position of the bracket-shaped clamping spring can be determined with the width of the closed side.

In one example, the bracket-shaped clamping spring has a clamping direction which, upon electromagnetic activation of the yoke, is aligned parallel to a direction of movement of the armature or forms an acute angle with the direction of movement of the armature, wherein the first clamping arm and/or the second clamping arm are at least partially perpendicular aligned with respect to the clamping direction.

The first clamping limb can follow a movement of the armature, since the first clamping limb can be fixed in the receiving depression, in particular by means of the angled tab in the recess on the armature. Accordingly, a clamping direction can also follow the movement, in particular a rotational movement, of the armature and can cause the armature to be mounted on the yoke in a spring-loaded manner.

If the first clamping limb is at least partially angled with respect to the armature and/or if the second clamping limb is arranged at least partially angled with respect to the yoke, the clamping direction, which is effected by the two clamping limbs, can deviate from a direction of movement of the armature and the direction of movement of the armature can form an acute angle with the clamping direction. This results in a relative, in particular reduced, clamping force of the bracket-shaped clamping spring in the direction of movement of the armature. The bracket-shaped clamping spring can be adapted to apply a sufficiently high clamping force, even when the armature does not move parallel to the clamping direction of the bracket-shaped clamping spring, in order to mount the armature in a clamping manner on the yoke. In particular, a relative movement of the armature with respect to the yoke in the bearing point can thus be prevented.

In one example, the bracket-shaped clamping spring comprises a spring force, which, when the bracket-shaped clamping spring is deflected, is proportional, in particular linearly proportional, to a deflection distance, and wherein the bracket-shaped clamping spring is adapted to prevent a relative movement of the armature without electromagnetic activation of the yoke.

The spring force can in particular be positively proportional or almost constant to the deflection distance, so that a lower force, which is generated in particular electromagnetically by means of the yoke, can be necessary for an initial movement of the armature from an initial position than a force for a reset of the armature from an end position to the starting position, which is applied in particular by the tensioned bracket-shaped clamping spring. An efficient and reliable movement of the armature can thereby be realized. The bracket-shaped clamping spring is in particular a constant force spring.

For example, the magnetic field generated by electromagnetic coils after the start of a current flow through the electromagnetic coils can have a reduced, increasing magnetic field strength. Even this reduced magnetic field strength can be used with a positively proportional adaptation of the spring force to move the armature in order to deflect the armature. As the deflection distance of the bracket-shaped spring increases, the spring force to be overcome can also increase, which, however, can be compensated for by the magnetic field strength that increases with increasing coil current. Likewise, a magnetic field which continues to exist after a current flow through the electromagnetic coils has been switched off and which decreases in magnetic field strength can initiate a movement of the armature from the end position in the direction of the start position. If the armature approaches the yoke after some time, the magnetic field of the yoke can already be sufficiently reduced to move the armature into the initial position with the spring force.

In one example, the spring force of the bracket-shaped clamping spring can be negatively proportional to the deflection distance. Accordingly, a movement of the armature from the initial position can be prevented in the case of low magnetic field strengths. The bracket-shaped clamping spring can produce a higher spring force in the initial position of the armature than in the end position of the armature. Accordingly, the bracket-shaped clamping spring can have a spring force threshold value which can be compensated for, for example, by a magnetic force acting on the armature, in order to realize a movement of the armature. With an increase in the distance between the armature and the yoke, the magnetic force acting on the armature can be reduced. However, the spring force which counteracts the magnetic force can then also be reduced, so that a further movement of the armature can be carried out. Furthermore, bouncing between two electrical contacts when the relay falls back can be prevented or at least reduced with a bracket-shaped clamping spring adapted in this way.

In one example, the angled tab is adapted to cause a compressive force on the armature and the second clamping limb by engaging in the recess, wherein the compressive force on the second clamping limb is transmitted by means of a transmission of the compressive force via a bearing surface of the armature with which the armature lies on the yoke, and a further transmission of the pressure force via a yoke support surface with which the yoke lies on the second clamping limb.

This has the advantage that the armature and the yoke can be force-fittingly connected by means of the bracket-shaped clamping spring. The compressive force exerted by the angled tab can be compensated for by a further compressive force exerted by means of the second clamping limb, which is directed against the compressive force of the angled tab. Accordingly, the tight fit of the armature on the yoke can be improved by pressing it by means of the first clamping limb, in particular by means of the angled tab, and the second clamping limb.

The angled tab can in particular engage elastically in the recess so that the compressive force of the angled tab continues to be exerted on the armature even if the angled tab moves relative to the recess, for example due to a movement of the armature.

In one example, the second clamping limb comprises a pre-tension acting in the direction of the yoke, with which the second clamping limb presses against the yoke. This has the advantage that the second clamping limb can be arranged in a fixed position on the yoke. In particular, static friction between the second clamping limb and the yoke can advantageously be increased by means of the pre-tension.

In one example, the bracket-shaped clamping spring is formed in one piece. This has the advantage that a force transmission between the first clamping limb and the second clamping limb can be implemented efficiently. Furthermore, the weight of the bracket-shaped clamping spring can advantageously be reduced, since in particular the first clamping limb can be connected to the second clamping limb without mechanical connection points. Furthermore, the bracket-shaped clamping spring can have continuous material properties by manufacturing the bracket-shaped clamping spring from a continuous, uniform material. In particular, the elasticity and deformability of the bracket-shaped clamping spring can be constant.

The bracket-shaped clamping spring can be made from a sheet metal blank, on which the first clamping limb and/or the second clamping limb are formed by means of reshaping, in particular by means of bending. Furthermore, the sheet metal blank can be reshaped after being inserted into the receiving depression and/or the recess in order to realize an angled arrangement of the first clamping limb to the second clamping limb and/or a pre-tension of the angled tab, the first clamping limb and/or the second clamping limb. The sheet metal blank can also be produced from a flat sheet metal, in particular punched out.

In one example, the bracket-shaped clamping spring also comprises a spring clip which is formed on the angled tab and at least partially lies on the yoke, and wherein the spring clip is adapted to apply a spring force acting in the direction of the armature to the yoke. This has the advantage that a spring force and/or spring force characteristic curve of the bracket-shaped clamping spring, which is held on the armature and on the yoke via the first clamping limb and the second clamping limb, can be adapted. With the spring clip, a linear spring force characteristic curve of the clip-shaped clamping spring can in particular be realized, so that a reset force of the bracket-shaped clamping spring increases linearly with a stroke of the armature.

In one example, the spring clip is arranged at least partially at a distance from the first clamping limb, the second clamping limb, an armature end face and/or a yoke end face. The spring clip can in particular be shaped like a curl and have two bends in order to rest at least partially on the armature and/or the yoke. With the spring clip at a distance from the armature face and/or the yoke face, the spring clip can achieve a greater leverage for pressing the bracket-shaped clamping spring against the armature and/or against the yoke than the first clamping arm and/or the second clamping arm. As a result, the spring clip, for example, comprising a lower material expansion than the first clamping limb and/or the second clamping limb, can exert a clamping force of at least the same size on the armature and/or the yoke. With the curl-shaped geometry of the spring clip, a virtual pivot point of the spring clip can correspond to an axis of rotation of the armature, in particular an armature bearing. An axis of rotation of the spring clip can correspond to a support edge of the armature on the yoke against which the armature bearing spring rests.

Furthermore, a possible elastic deformation of the clip spring can achieve a higher clamping force of the bracket-shaped clamping spring with respect to the armature or the yoke than a possible elastic deformation of the first clamping limb and/or the second clamping limb. The elastic deformation of the spring clip, the first clamping limb and/or the second clamping limb, in particular by means of bending, can be determined by a transition to plastic deformation at a bending limit value of the material of the bracket-shaped clamping spring.

In one example, the bracket-shaped clamping spring has a further spring clip which is integrally formed on the angled bracket and is arranged at least partially at a distance from the first clamping limb and/or the second clamping limb. This has the advantage that the bracket-shaped clamping spring can be adapted symmetrically, in particular symmetrically with respect to a surface normal axis of the surface of the armature. One spring clip, respectively, can be arranged on the side of the angled tab. Furthermore, the spring clip and the further spring clip can be shaped similarly, in particular identically, so that the spring clips each press with a comparable contact pressure against the bearing surface of the yoke or the armature.

In one example, the spring clip is connected to the second clamping limb on the yoke side in order to form a common support surface of the spring clip and the second clamping limb, which lies flat on the yoke.

This has the advantage that different pressing forces of the second clamping limb and the first spring clip can be compensated via the connection on the yoke side. In particular, a pressing force of the second clamping limb can be combined with a pressing force of the spring clip and press as a combined pressing force on the bearing surface of the yoke.

The connection between the second clamping limb and the yoke can be realized by means of a yoke-side connection plate which rests at least partially flat on the support surface of the yoke. The second clamping limb and/or the spring clip can be connected at an angle to the connecting plate on the yoke side.

In one example, the spring clip is arranged at least partially at an angle to the receiving depression and/or the yoke in order to increase a contact pressure with which the spring clip acts on the receiving depression and/or a yoke support surface, wherein an overall height of the angled arrangement of the spring clip in the receiving depression is less than or equal to the receiving depth of the receiving depression. The spring clip can be adapted to be elastic and can have a pretensioned shape, which is deformed, in particular stretched, by the support of the spring clip on the yoke and/or on the armature. As a result, a compressive force can act on the armature and/or the yoke by means of the material elasticity of the spring clip. With an angled arrangement and/or adaptation of the spring clip which does not reach a receiving depth of the receiving depression, the spring clip can be arranged at the armature without increasing the installation space of the relay in the direction of a surface normal axis of the receiving depression.

In one example, the spring clip has two flexible spring sections with which the spring clip is U-shaped, and wherein the two flexible spring sections each having a smaller curvature in respect to the bending sections formed at the first clamping limb and/or the second clamping limb.

This achieves the advantage that the bending sections of the spring clip can have a greater expansion than the bending sections of the bending sections formed on the first clamping limb or the second clamping limb. Correspondingly, an elastic deformation opposite to a bending direction of the respective bending sections in the spring clip can be distributed over a larger material area compared to the clamping limbs. Thus, the spring clip with the bending sections can have a larger flexible elastic area than the bending sections formed at the respective clamping limbs.

In the direction of a surface normal axis to the end face of the armature and/or the end face of the yoke, the spring clip can have an overall width that is larger than that of the clamping limbs, which are limited by the connecting plate. In particular, the spring clip can be arranged further away from the end face of the armature and/or the end face of the yoke than the first clamping limb, the second clamping limb and/or the connecting plate.

In one example, the bracket-shaped clamping spring comprises a curved connecting plate which is formed at the second clamping limb, and wherein the curved connecting plate comprises a curvature which rests with a convex contact surface on the armature face and/or on the yoke face.

In one example, the bent connecting plate is fastened to the yoke by means of a material connection, in particular is welded to the yoke.

BRIEF DESCRIPTION OF THE DRAWINGS

Further examples are explained with reference to the accompanying figures. They show.

DETAILED DESCRIPTION

Figure 1:
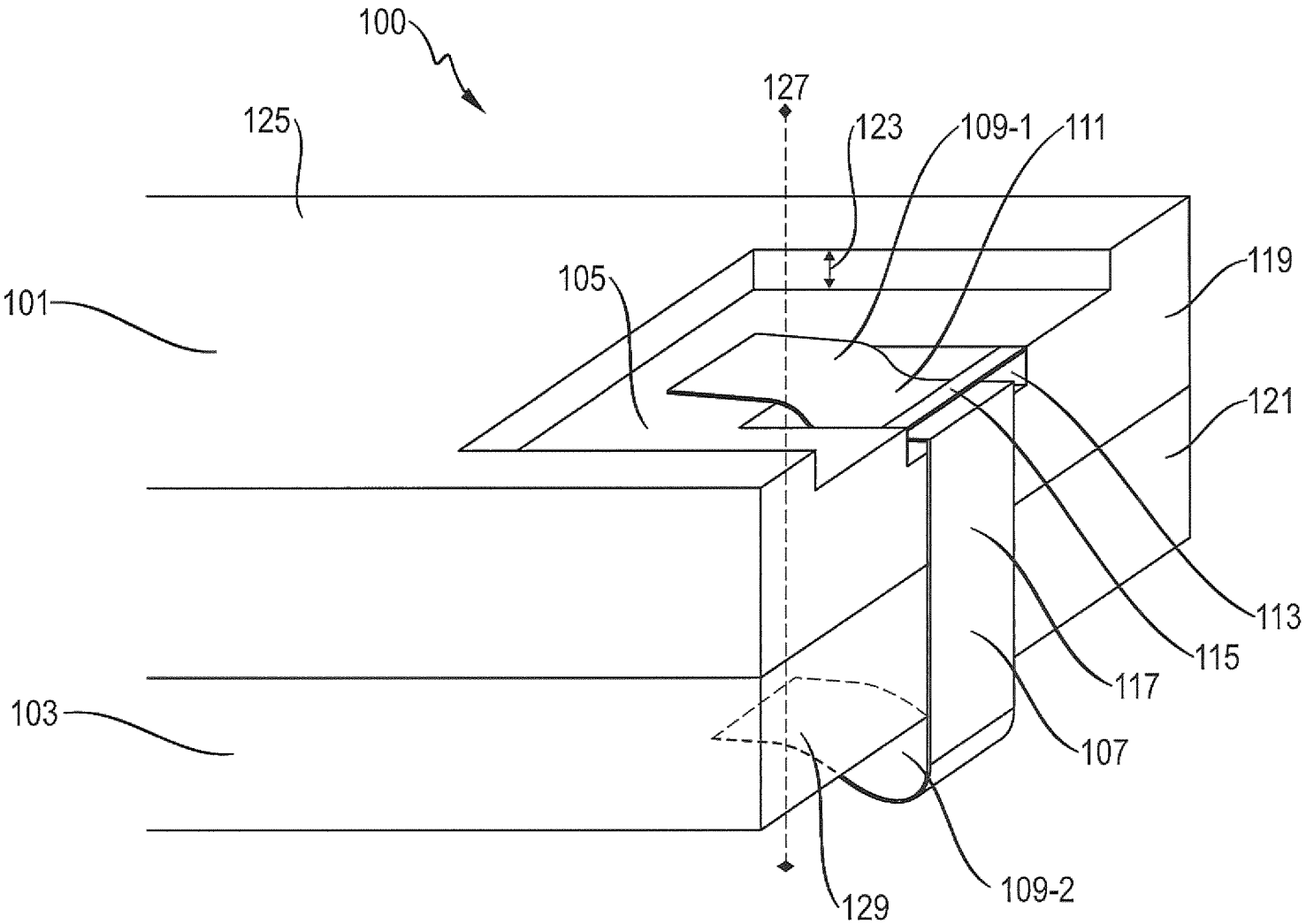
FIG. 1 shows a relay in one example.

FIG. 1 shows a schematic representation of the relay 100 with an armature 101 and a yoke 103, which can be electromagnetically coupled to the armature 101. The armature 101 lies at least partially flat on the yoke 103 and a receiving depression 105 is partly formed in the armature 101. The relay 100 furthermore comprises a bracket-shaped clamping spring 107 which surrounds the armature 101 and the yoke 103 on the end face in order to fix the armature 101 on the yoke 103. The bracket-shaped clamping spring 107 has a first clamping limb 109-1, which is arranged in the receiving depression 105, and a second clamping limb 109-2, which lies on the yoke 103. Furthermore, the first clamping limb 109-1 has an angled tab 111 which engages elastically in a recess 113 formed in the receiving depression 105 of the armature 101.

The armature 101 has a web 115 which at least partially bridges the recess 113 and/or terminates flush with the receiving depression 105. The web 115 forms a closed, rectangular opening on the armature end face 119 through which the angled tab 111 passes. Furthermore, the recess 113 with the web 115 forms a further closed, rectangular opening in the receiving depression, through which the angled tab 111 passes. The receiving depression 105 is cuboid and has a homogeneous overall depth 123.

The angled tab 111 can be S-shaped in order to overcome a difference in installation depth between the receiving depression 105 and the recess 113. The angled tab 111 can lie at least partially on the receiving depression 105 and a bottom surface of the recess 113.

In one example, the angled tab 111 passes through the recess in such a way that the angled tab 111 does not contact a bottom surface and/or one of the side surfaces of the recess 113, in particular is arranged at a distance from them.

Furthermore, the bracket-shaped clamping spring 107 has a connecting plate 117, which connects the first clamping limb 109-1 to the second clamping limb 109-2, and wherein the connecting plate 117 lies on an armature end face 119 and/or on a yoke end face 121. The connecting plate 117 is rectangular in shape and is arranged parallel and at a distance to the armature end face 119 and the yoke end face 121. Furthermore, the angled tab 111 is arranged at least partially perpendicular to the connecting plate.

A receiving depth 123 of the receiving depression 105 is at least equal to or greater than a structural depth of the first clamping limb 109-1 arranged in the receiving depression 105 in order to arrange the bracket-shaped clamping spring 107 on the armature side below a surface 125 of the armature 101. The overall depth of the first clamping limb 109-1 can be determined by a material thickness and/or a shape of the first clamping limb 109-1.

The bracket-shaped clamping spring 107 has a clamping direction 127 which, when the yoke 103 is activated electromagnetically, is aligned parallel to a direction of movement of the armature 101 or forms an acute angle with the direction of movement of the armature 101, and wherein the first clamping limb 109-1 and/or the second clamping limbs 109-2 are at least partially aligned perpendicular to the clamping direction 127.

The bracket-shaped clamping spring 107 is adapted to prevent a relative movement of the armature 101 without electromagnetic activation of the yoke 103 and is also formed in one piece.

Furthermore, the angled tab 111 is adapted to cause a pressure force on the armature 101 and the second clamping limb 109-2 by engaging in the recess 113, wherein the pressure force is transmitted on the second clamping limb 109-2 by means of a transmission of the pressure force via a support surface of the armature 101, with which the armature 101 lies on the yoke 103, and a further transmission of the pressure force via a yoke support surface 129, with which the yoke 103 lies on the second clamping limb 109-2. The second clamping limb 109-2 has a pre-tension acting in the direction of the yoke 103, with which the second clamping limb 109-2 presses against the yoke 103.

Figure 2:
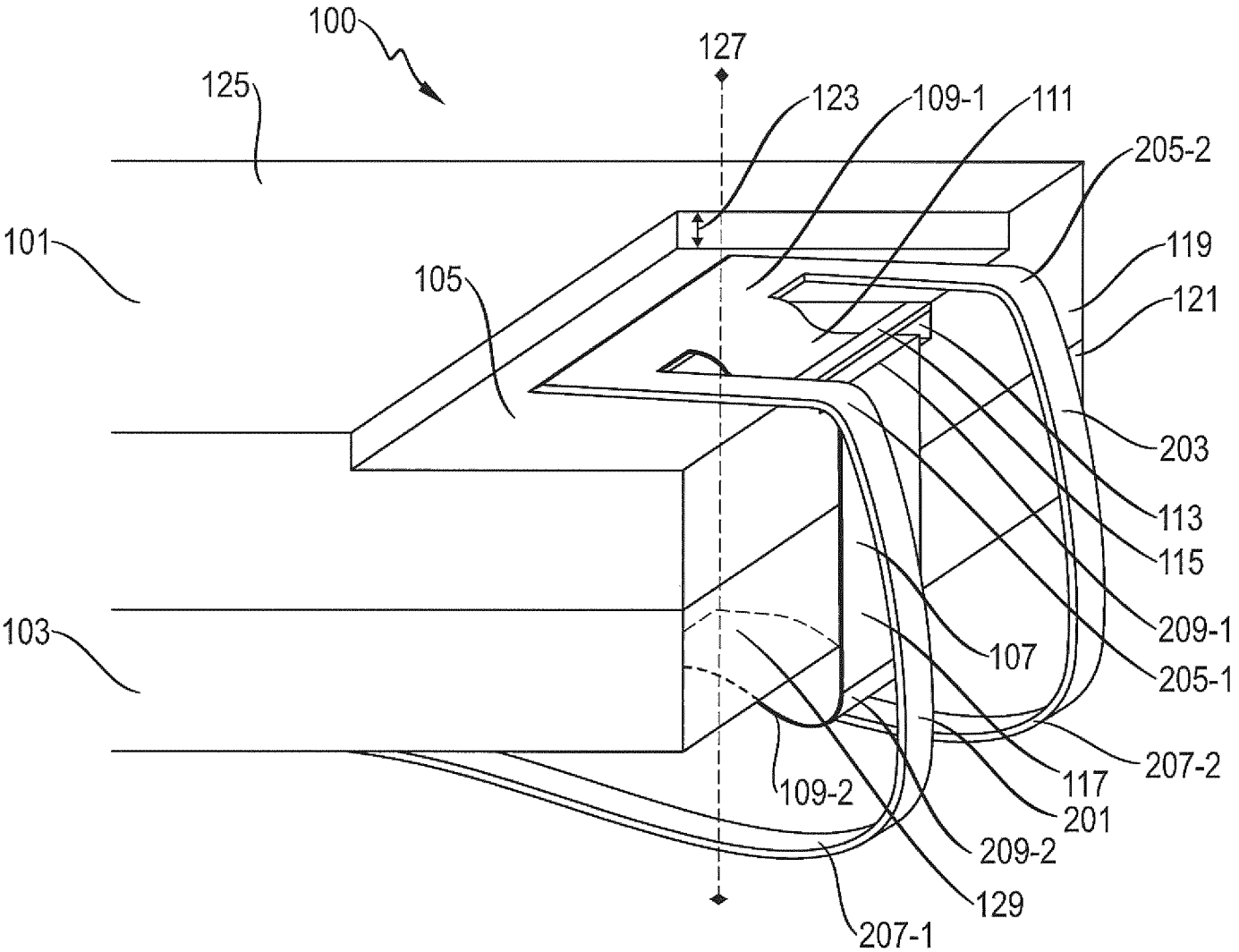
FIG. 2 shows a relay in one example.

FIG. 2 shows a schematic representation of the relay 100 with an armature 101 and a yoke 103, which can be electromagnetically coupled to the armature 101. The armature 101 lies at least partially flat on the yoke 103 and a receiving depression 105 is partly formed in the armature 101. The relay 100 furthermore comprises a bracket-shaped clamping spring 107 which engages around the end face of the armature 101 and the yoke 103 in order to fix the armature 101 on the yoke 103. The bracket-shaped clamping spring 107 has a first clamping limb 109-1, which is arranged in the receiving depression 105, and a second clamping limb 109-2, which lies on the yoke 103. Furthermore, the first clamping limb 109-1 has an angled tab 111 which engages elastically into a recess 113 formed in the receiving depression 105 of the armature 101.

Furthermore, the bracket-shaped clamping spring 107 comprises a spring clip 201 and a further spring clip 203, which are each formed at the angled bracket 111 and each lie at least partially on the yoke 103. The spring clips 201, 203 are adapted to act on the yoke 103 with a spring force acting in the direction of the armature 101. The spring clips 201, 203 are each arranged at least partially at a distance from the first clamping limb 109-1, the second clamping limb 109-2, an armature end face 119 and/or a yoke end face 121.

The spring clip 201 is connected to the second clamping limb 109-2 on the yoke side in order to form a common support surface of the spring clip 201 and the second clamping limb 109-2, which lies flat on the yoke 103. Furthermore, the spring clip 201 is at least partially arranged at an angle to the receiving depression 105 and/or the yoke 103 in order to increase a contact pressure with which the spring clip 201 acts on the receiving depression 105 and/or a yoke support surface 129, wherein a structural height of the angled arrangement of the spring clip 201 in the receiving depression 105 is less than or equal to the receiving depth 123 of the receiving depression 105.

The spring clip 201 has two flexible spring sections 205-1, 207-1, with which the spring clip 201 is U-shaped, and the two flexible spring sections 205-1, 207-1 each have a smaller curvature in respect to the bending sections 209-1, 209-2 formed at the first clamping limb 109-1 and the second clamping limb 109-2. Furthermore, the flexible spring section 205-1 has a smaller curvature than the spring bending section 207-1. The flexible spring sections 205-2, 207-2 of the further spring clip 203 are similar in shape and curvature to the corresponding flexible sections 205-1, 207-1 of the spring clip 201.

The receiving depression 105 is open to the side. In this way, the bracket-shaped clamping spring 107 can be pushed laterally onto the armature 101 and/or the yoke 103, for example. For this purpose, the recess 113 in the armature 101 can be completely open, in particular not limited by a web 115, in order to enable the angled tab 111 to penetrate into the recess 113 during or after sliding the bracket-shaped clamping spring 107 onto the armature 101. Penetration of the angled tab 111 into the recess 113 can be realized with the web 115, if the angled tab 111 is passed under the web 115 after the bracket-shaped clamping spring 107 has been pushed onto the armature 101 by means of deformation, in particular by bending.

Figure 3:
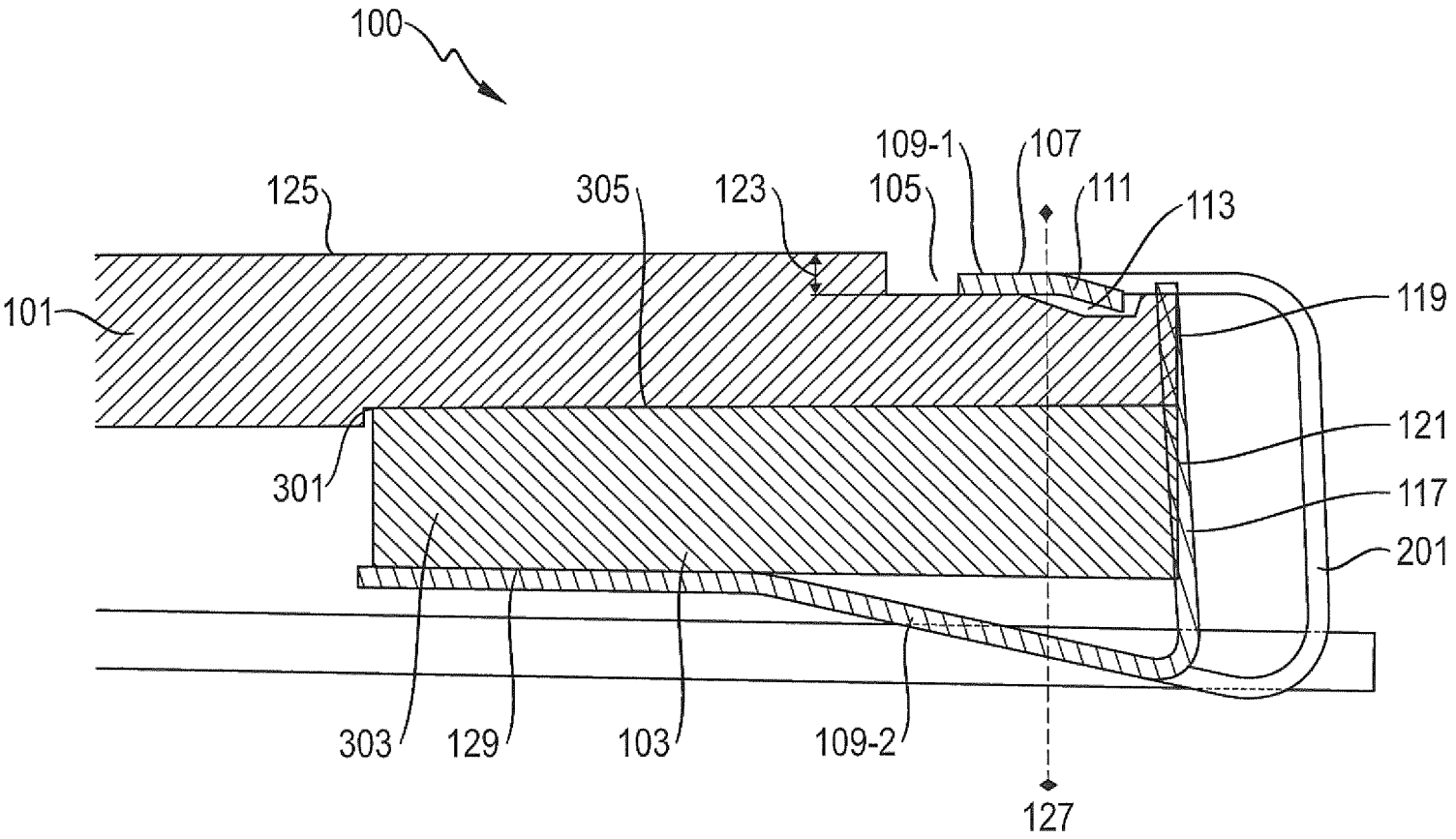
FIG. 3 shows a relay in one example.

FIG. 3 shows a schematic cross-sectional view of the relay 100 with an armature 101 and a yoke 103, which can be electromagnetically coupled to the armature 101. The armature 101 lies at least partially flat on the yoke 103 and a receiving depression 105 is partly formed in in the armature 101. The relay 100 furthermore comprises a bracket-shaped clamping spring 107 which engages around the end face of the armature 101 and the yoke 103 in order to fix the armature 101 on the yoke 103. The bracket-shaped clamping spring 107 has a first clamping limb 109-1, which is arranged in the receiving depression 105, and a second clamping limb 109-2, which lies on the yoke 103. Furthermore, the first clamping limb 109-1 has an angled tab 111 which engages elastically in a recess 113 formed in the receiving depression 105 of the armature 101.

Furthermore, the bracket-shaped clamping spring 107 has a spring clip 201 which is formed at the angled tab 111 and at least partially lies on the yoke 103. The spring clip 201 is adapted to act on the yoke 103 with a spring force acting in the direction of the armature 101. Furthermore, the armature 101 has a depression 301 in which the yoke 103 or at least one limb of the yoke 103 is arranged. The spring clip 201 is arranged completely in the receiving depression 105 with respect to the receiving depth 123. The sections of the spring clip 201 which protrude beyond the armature 101 in the direction of a surface normal axis of the armature end face 119 also do not reach the receiving depth 123 with their overall height, so that the spring clip 201 advantageously does not increase the overall height of the relay 100 in the direction of the receiving depth 123.

Furthermore, the angled tab 111 is adapted to effect a compressive force on the armature 101 and the second clamping limb 109-2 by engaging in the recess 113, wherein the compressive force is transmitted on the second clamping limb 109-2 by means of a transmission of the compressive force via a support surface 305 of the armature 101, with which the armature 101 lies on the yoke 103, and by a further transmission of the pressure force via a yoke support surface 129, with which the yoke 103 lies on the second clamping limb 109-2. The second clamping limb 109-2 has a pre-tension acting in the direction of the yoke 103, with which the second clamping limb 109-2 presses against the yoke 103.

Figure 4:
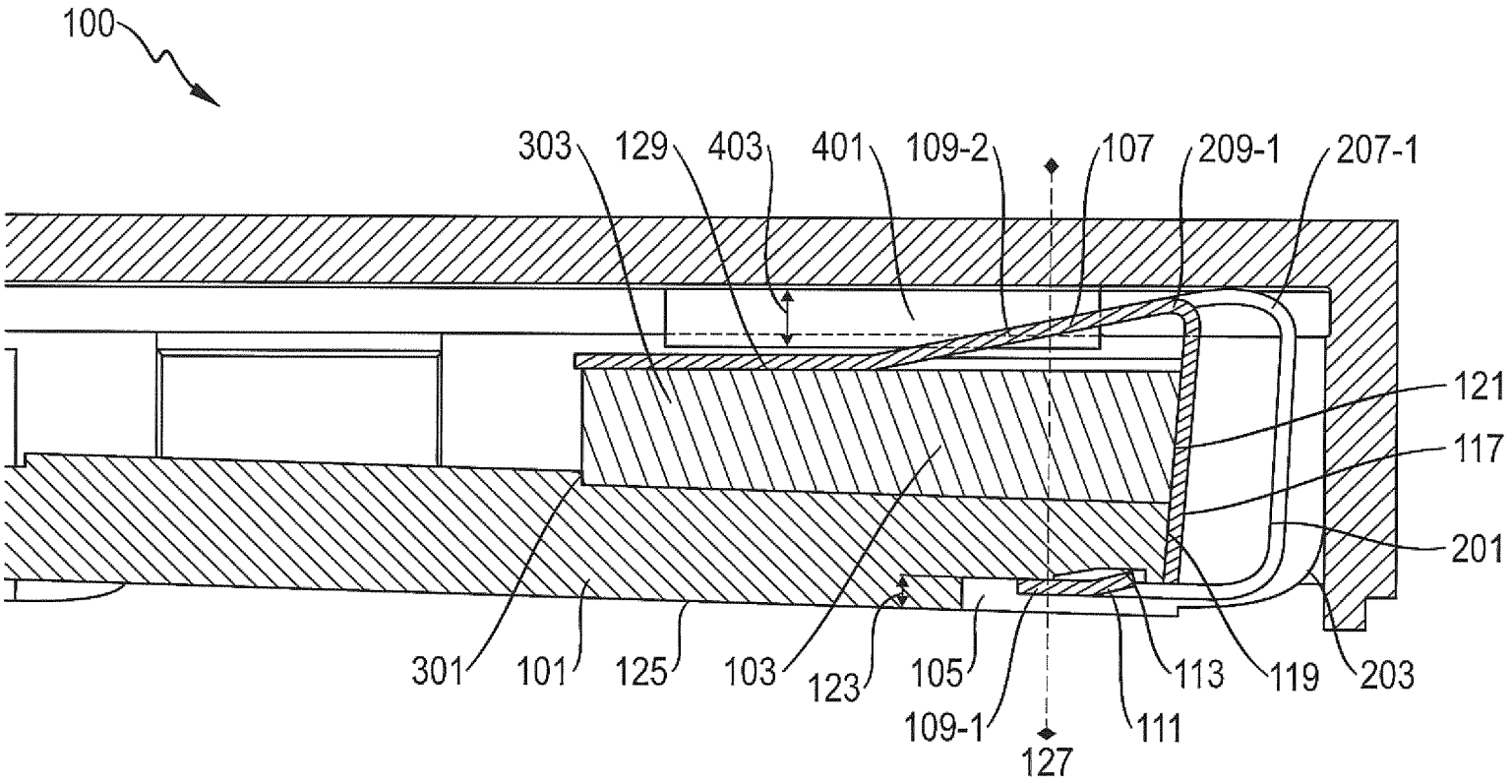
FIG. 4 shows a relay in one example.

FIG. 4 shows a schematic cross-sectional view of the relay 100 comprising an armature 101 and a yoke 103, which can be electromagnetically coupled to the armature 101. The armature 101 lies at least partially flat on the yoke 103 and a receiving depression 105 is partly formed in the armature 101. The relay 100 furthermore comprises a bracket-shaped clamping spring 107 which engages around the end face of the armature 101 and the yoke 103 in order to fix the armature 101 on the yoke 103. The bracket-shaped clamping spring 107 comprises a first clamping limb 109-1, which is arranged in the receiving depression 105, and a second clamping limb 109-2, which lies on the yoke 103. Furthermore, the first clamping limb 109-1 has an angled tab 111 which engages elastically in a recess 113 formed in the receiving depression 105 of the armature 101.

Furthermore, the bracket-shaped clamping spring 107 has a spring clip 201 and a further spring clip 203, which are each formed at the angled bracket 111 and each lie at least partially on the yoke 103. The spring clips 201, 203 are adapted to act on the yoke 103 with a spring force acting in the direction of the armature 101. Furthermore, the armature 101 has a depression 301 in which the yoke 103 or at least one limb of the yoke 103 is arranged.

On the yoke side, both the second clamping limb 109-2 and the spring clip 201 protrude beyond a yoke support surface 129. However, this does not lead to an increase in the overall depth of the relay 100 in the direction of the receiving depth 123, since an electromagnetic coil 401 is arranged on at least one yoke limb 303, which coil has an overall coil depth 403. The second clamping limb 109-2 and/or the spring clip 201 can be shaped to take advantage of the existing coil depth 403 with the respective bending sections 209-1 and 207-1, respectively, in order to apply a compressive force to the yoke 103 and/or armature 101 via a respective pretensioned bend by the yoke support surface 129.

Figure 5:
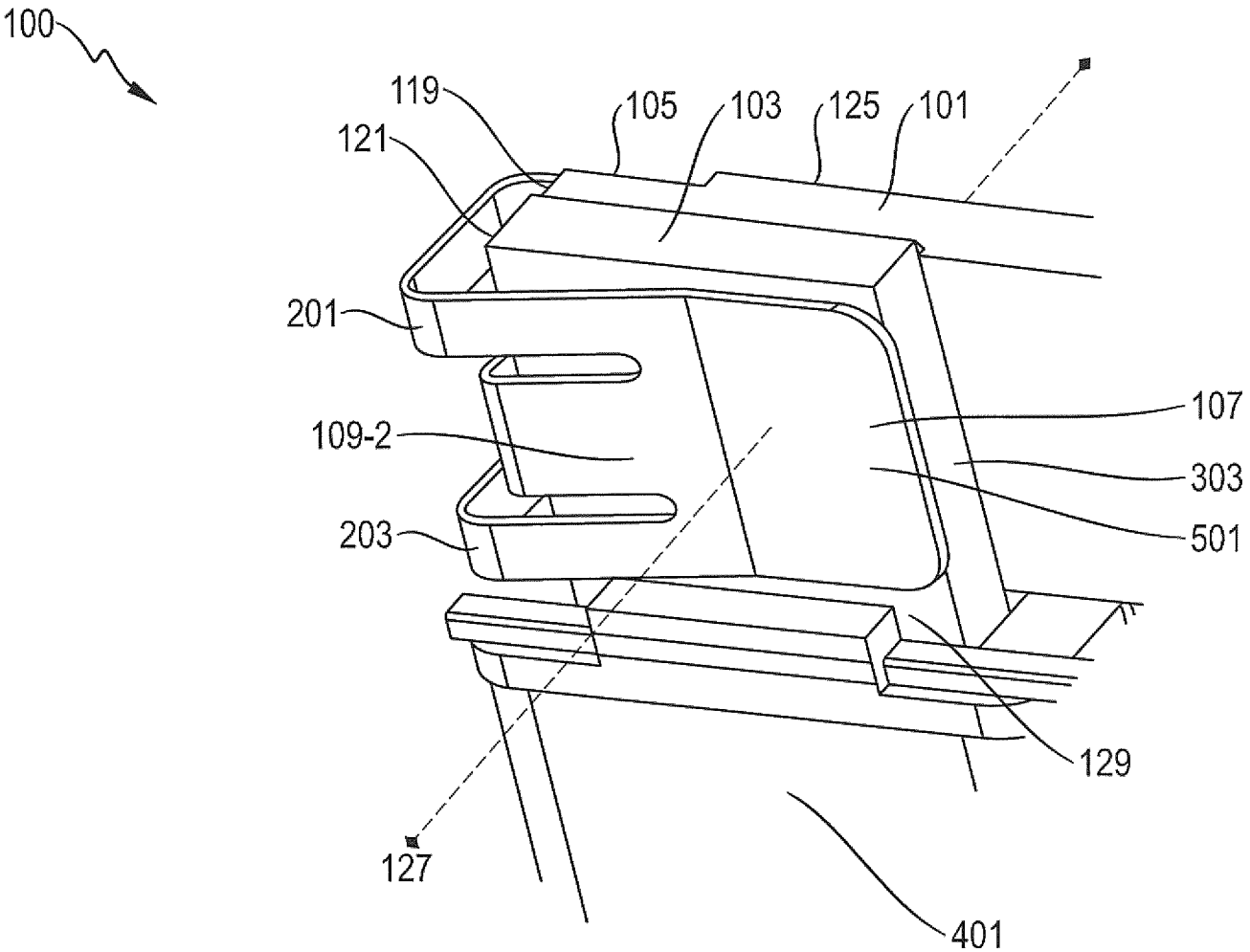
FIG. 5 shows a relay in one example.

FIG. 5 shows a schematic representation of the relay 100 comprising an armature 101 and a yoke 103. The armature 101 lies at least partially flat on the yoke 103 and a receiving depression 105 is partly formed in the armature 101. The relay 100 furthermore comprises a bracket-shaped clamping spring 107 which surrounds the end face of the armature 101 and the yoke 103 in order to fix the armature 101 on the yoke 103. The bracket-shaped clamping spring 107 has a second clamping limb 109-2, which lies on the yoke 103.

The bracket-shaped clamping spring 107 has a plate-shaped yoke support section 501 which connects the spring clip 201 and the further spring clip 203 to the second clamping limb 109-2. The plate-shaped yoke support section 501 lies flat on the yoke support surface 129 and ends with one edge of the yoke limb 303. The electromagnetic coil 401 is also arranged on the yoke limb 303.

The bracket-shaped clamping spring 107 has a clamping direction 127 which, when the yoke 103 is activated electromagnetically by means of the electromagnetic coil 401, is oriented parallel to a direction of movement of the armature 101 or forms an acute angle with the direction of movement of the armature 101. A joint line between the end face 119 of the armature 101 and the end face 121 of the yoke can form an axis of rotation for a deflection of the armature 101.

Figure 6:
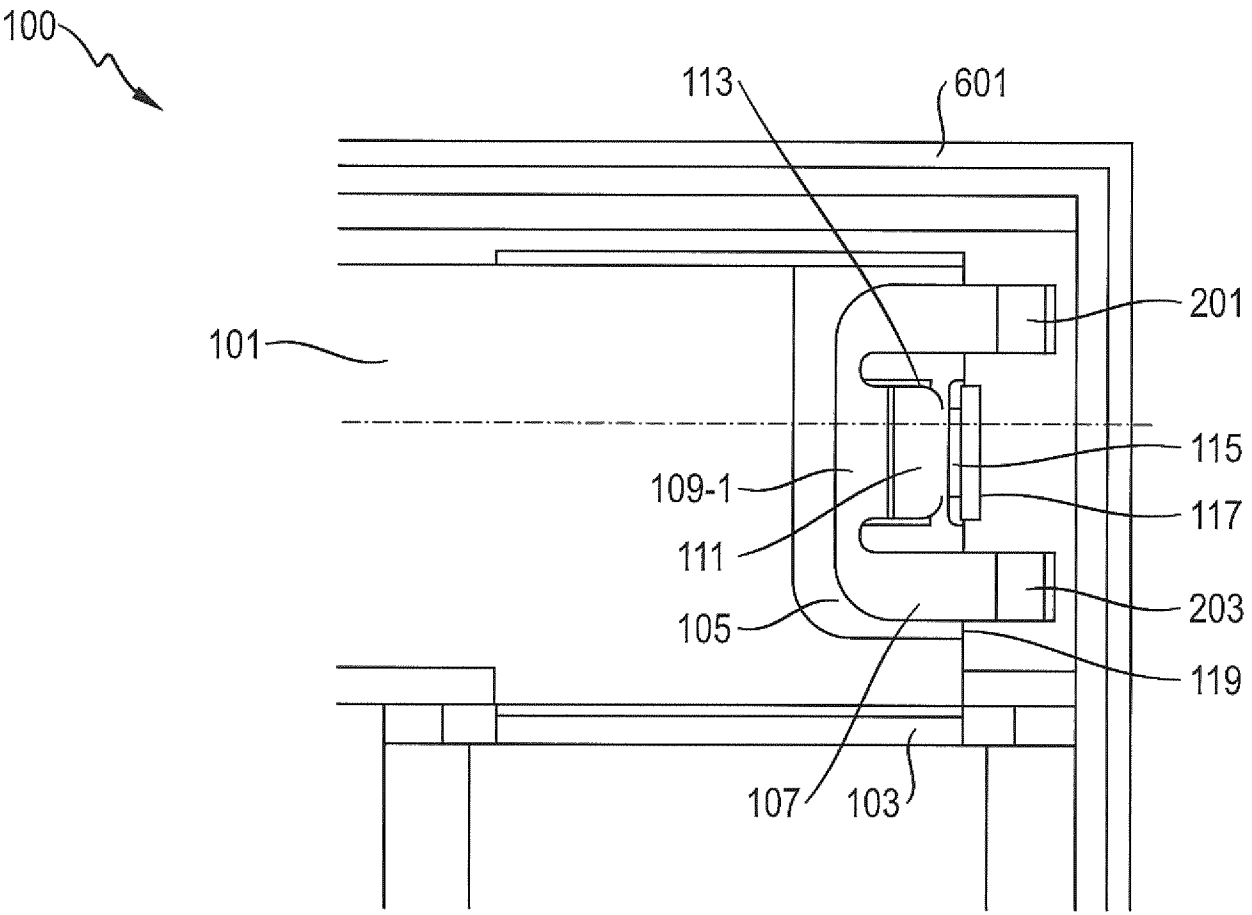
FIG. 6 shows a relay in one example.

FIG. 6 shows a schematic illustration of the relay 100 comprising an armature 101 and a yoke 103. The armature 101 lies at least partially flat on the yoke 103 and a receiving depression 105 is partly formed in the armature 101. The relay 100 furthermore comprises a bracket-shaped clamping spring 107 which surrounds the end face of the armature 101 and the yoke 103 in order to fix the armature 101 on the yoke 103. The bracket-shaped clamping spring 107 has a first clamping limb 109-1 which lies on the armature 101. The armature 101 has a web 115 which at least partially bridges the recess 113 and/or terminates flush with the receiving depression 105.

The spring clips 201, 203 are each arranged at least partially at a distance from the first clamping limb 109-1, the second clamping limb 109-2, an armature end face 119 and/or a yoke end face 121. Furthermore, the first clamping limb 109 1 has an angled tab 111 which engages elastically in the recess 113.

Furthermore, the combination of armature 101, yoke 103 and bracket-shaped clamping spring 107 is arranged in a relay housing which closes the relay 100. In particular, the relay 100 is sealed with the housing so that the relay is protected from external influences, in particular from dust and moisture, which could impair the function of the mechanical and electrical components of the relay.

Figure 7:
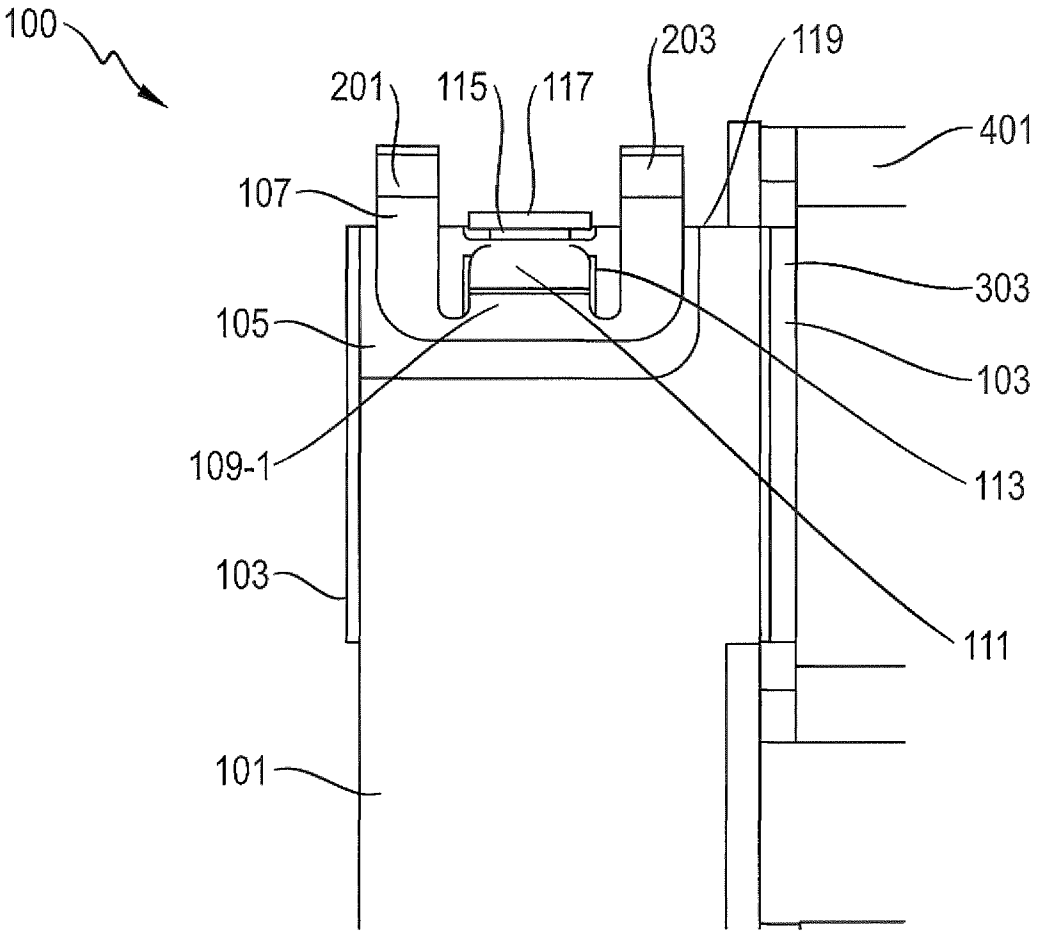
FIG. 7 shows a relay in one example.

FIG. 7 shows a schematic illustration of the relay 100 comprising an armature 101 and a yoke 103. The armature 101 lies at least partially flat on the yoke 103 and a receiving depression 105 is partly formed in the armature 101. The relay 100 furthermore comprises a bracket-shaped clamping spring 107 which surrounds the end face of the armature 101 and the yoke 103 in order to fix the armature 101 on the yoke 103. The bracket-shaped clamping spring 107 has a first clamping limb 109-1 which lies on the armature 101. The armature 101 has a web 115 which at least partially bridges the recess 113 and/or terminates flush with the receiving depression 105.

The spring clips 201, 203 have, in the direction of a surface normal axis of the armature end face 119, an overall width that is larger than that of the first clamping limb 109-1 delimited by the connecting plate 117. In particular, the spring clips 201, 203 are arranged further away from the end face 119 of the armature 101 than the first clamping limb 109-1 and the connecting plate 117. However, the overall width of the spring clips 201, 203 is smaller than an overall width of the electromagnetic coil 401 on the yoke limb 303, so that by the overall width of the spring clips 201, 203 does a resulting overall width of the relay 100 is advantageously not increased. Furthermore, the first clamping limb 109-1 has an angled tab 111 which engages elastically in the recess 113. The recess 113 is at least partially delimited by the web 115.

Figure 8:
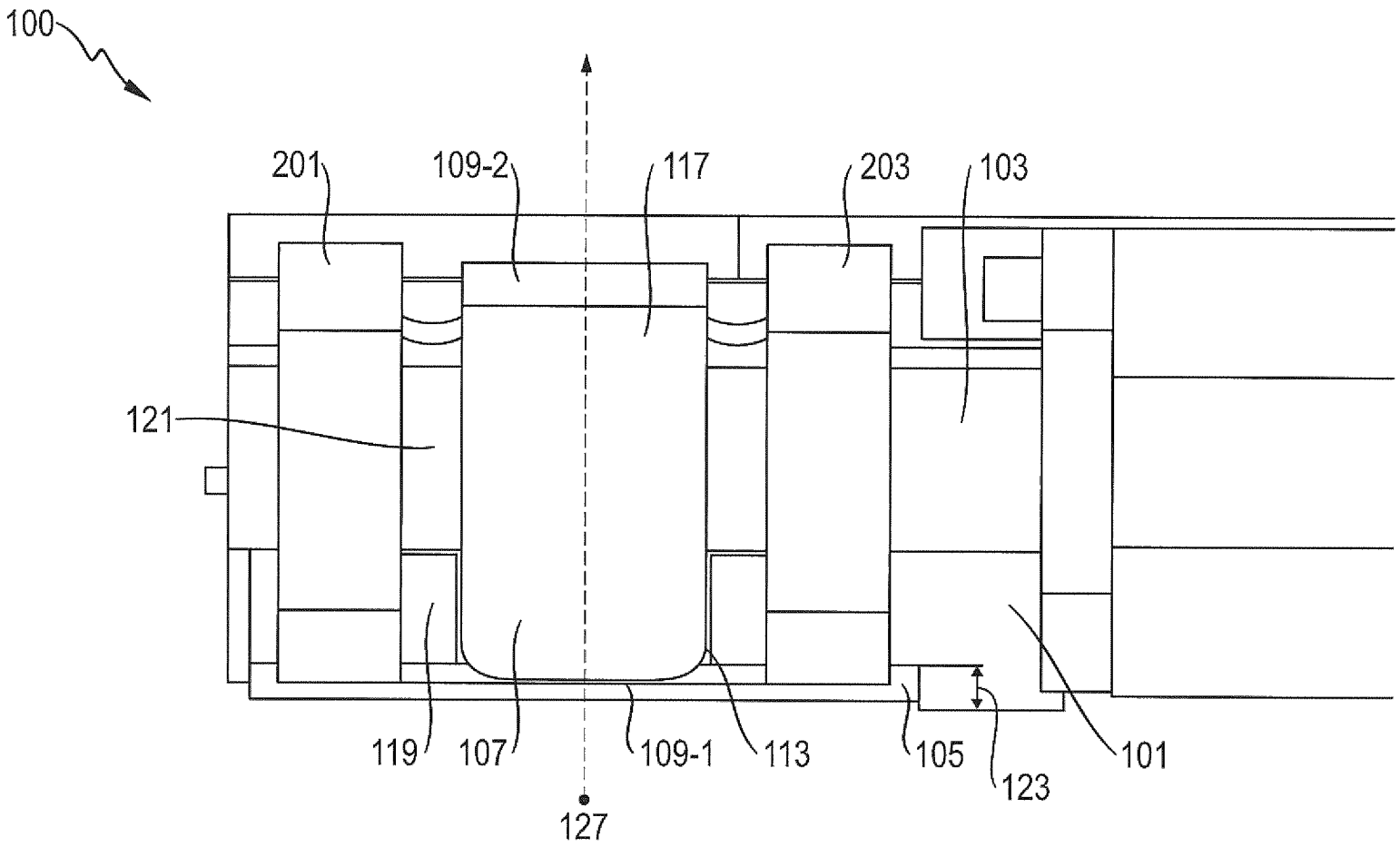
FIG. 8 shows a relay in one example.

FIG. 8 shows a schematic representation of the relay 100 comprising an armature 101 and a yoke 103. The armature 101 lies at least partially flat on the yoke 103, and a receiving depression 105 is partly formed in the armature 101. The relay 100 furthermore comprises a bracket-shaped clamping spring 107 which surrounds the end face of the armature 101 and the yoke 103 in order to fix the armature 101 on the yoke 103. The bracket-shaped clamping spring 107 has a first clamping limb 109-1 which lies on the armature 101. The armature 101 has a web 115 which at least partially bridges the recess 113 and/or terminates flush with the receiving depression 105.

Furthermore, the bracket-shaped clamping spring 107 has a connecting plate 117 which connects the first clamping limb 109-1 to the second clamping limb 109-2. The connecting plate 117 lies on an armature end face 119 and/or on a yoke end face 121. The connecting plate 117 is rectangular in shape.

Figure 9:
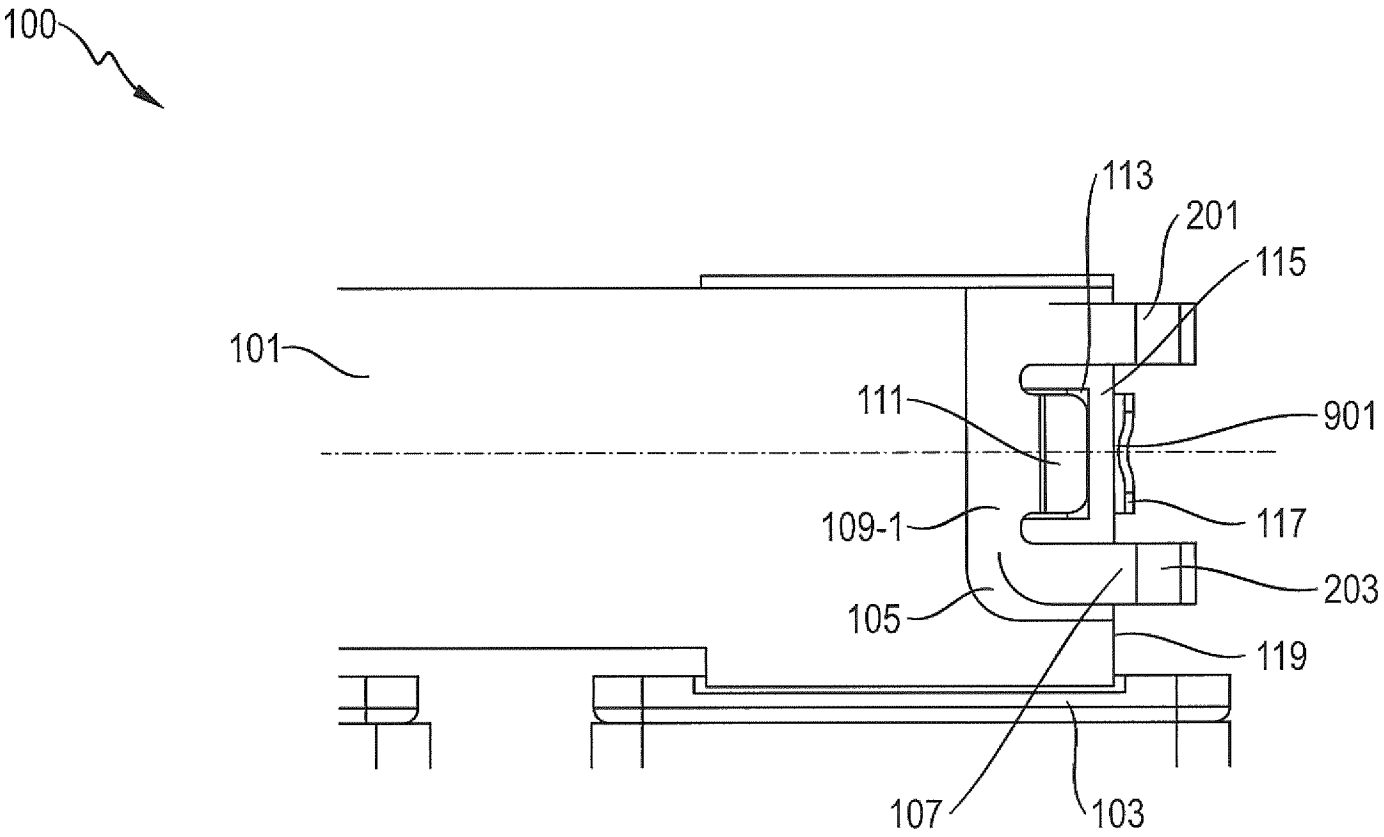
FIG. 9 shows a relay in one example.

FIG. 9 shows a schematic illustration of the relay 100 comprising an armature 101 and a yoke 103. The armature 101 lies at least partially flat on the yoke 103 and in the armature 101 a receiving depression 105 is partly formed. The relay 100 furthermore comprises a bracket-shaped clamping spring 107 which engages around the end face of the armature 101 and the yoke 103 in order to fix the armature 101 on the yoke 103. The bracket-shaped clamping spring 107 has a first clamping limb 109-1 which lies on the armature 101. The armature 101 has a web 115 which at least partially bridges the recess 113 and/or terminates flush with the receiving depression 105.

The spring clips 201, 203 are each arranged at least partially at a distance from the first clamping limb 109-1, the second clamping limb 109-2, the armature end face 119. Furthermore, the first clamping limb 109-1 has an angled tab 111 which engages elastically in the recess 113.

The bracket-shaped clamping spring 107 has a curved connecting plate 117 which is formed at the second clamping limb 109-2, and wherein the curved connecting plate 117 has a curvature 901 which lies with a convex contact surface on the armature end face 119 and/or on the yoke end face 121. Furthermore, the curved connecting plate 117 is fastened to the yoke 103 by means of a material connection, in particular is welded to the yoke 103. The bracket-shaped clamping spring can have a curvature 901, in particular a spoon-shaped shape, and can bear against the armature end face 119 with a convex surface.

Figure 10:
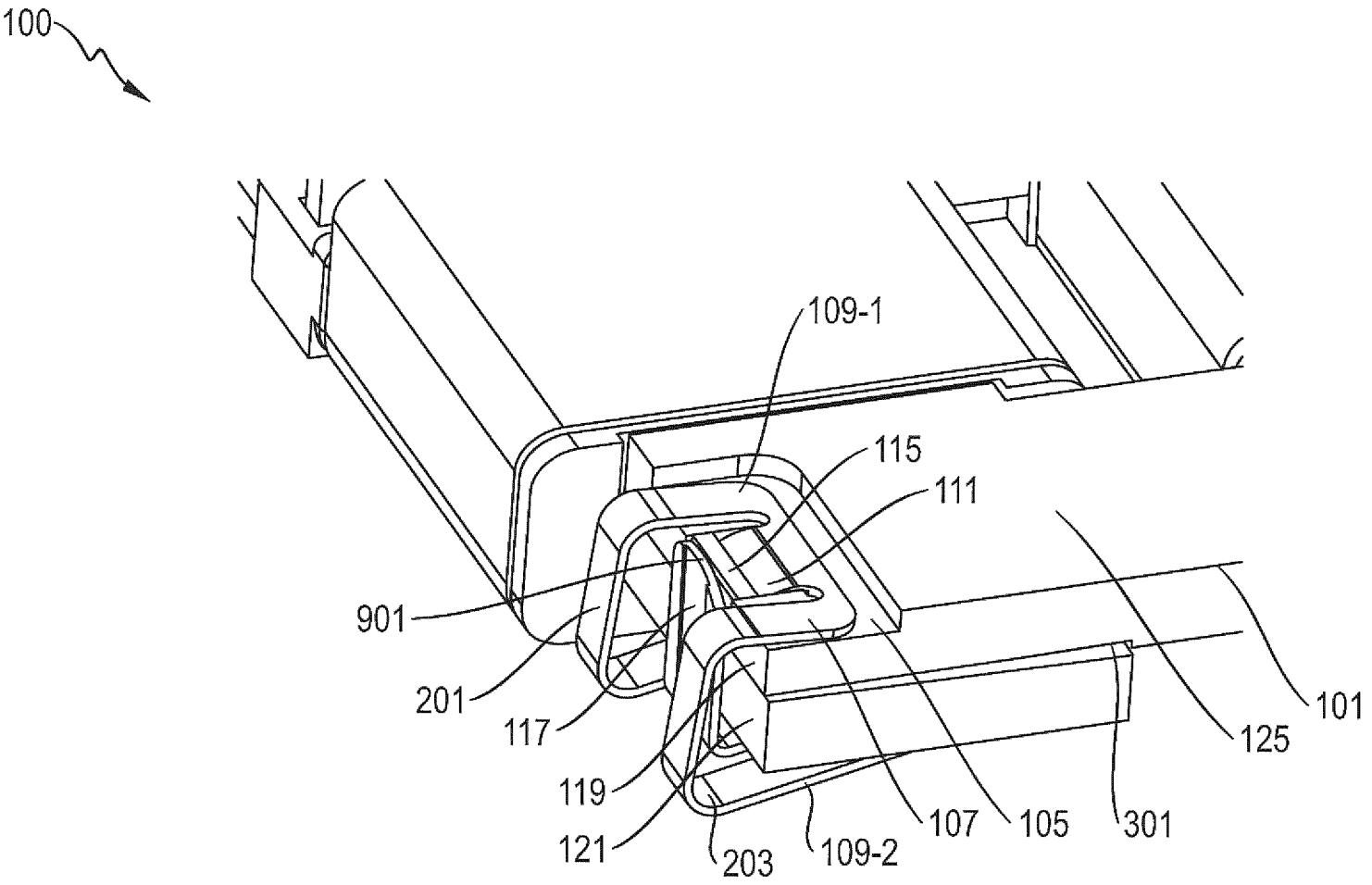
FIG. 10 shows a relay in one example.

FIG. 10 shows a perspective illustration of the relay according to the example shown in FIG. 9. The spring clips 201, 203 are adapted to act on the yoke 103 with a spring force acting in the direction of the armature 101. Furthermore, the armature 101 has a depression 301 in which the yoke 103 or at least one limb of the yoke 103 is arranged. With the depression 301, a working gap can be formed between the yoke 103 and the armature 101, which gap becomes larger with increasing distance from the armature end face 119, so that the distance between the yoke 103 and the armature 101 increases. A support edge of the armature 101 on an edge between the armature end face 119 and the yoke end face 121 can be an axis of rotation of the armature 101 and/or the bracket-shaped clamping spring 107 when the relay 100 is actuated electromagnetically.

FIG. 11 a shows a schematic plan view of the bracket-shaped clamping spring 107, which has a first clamping limb 109-1 and a second clamping limb 109-2. The spring clips 201, 203 are each arranged at least partially at a distance from the first clamping limb 109-1 and the second clamping limb 109-2. Furthermore, the first clamping limb 109 1 has an angled tab 111.

Furthermore, the bracket-shaped clamping spring 107 has a connecting plate 117 which is formed at the second clamping limb 109-2. In one example, the connecting plate 117 is arranged at a distance from the angled tab 111, so that the angled tab 111 cannot be connected to the connecting plate 117 at a possible abutment point. Furthermore, the connecting plate 117 has a curvature 901 in the form of an at least partially lowered shape with a centrally arranged cylindrical depression, so that the connecting plate 117 lies on the armature end face with a convex surface on the armature face 119. The curvature 901 can extend in the direction of the first clamping limb 109-1 up to one end of the connecting plate 117, so that the connecting plate 117 has a curved edge profile.

Figure 11A:
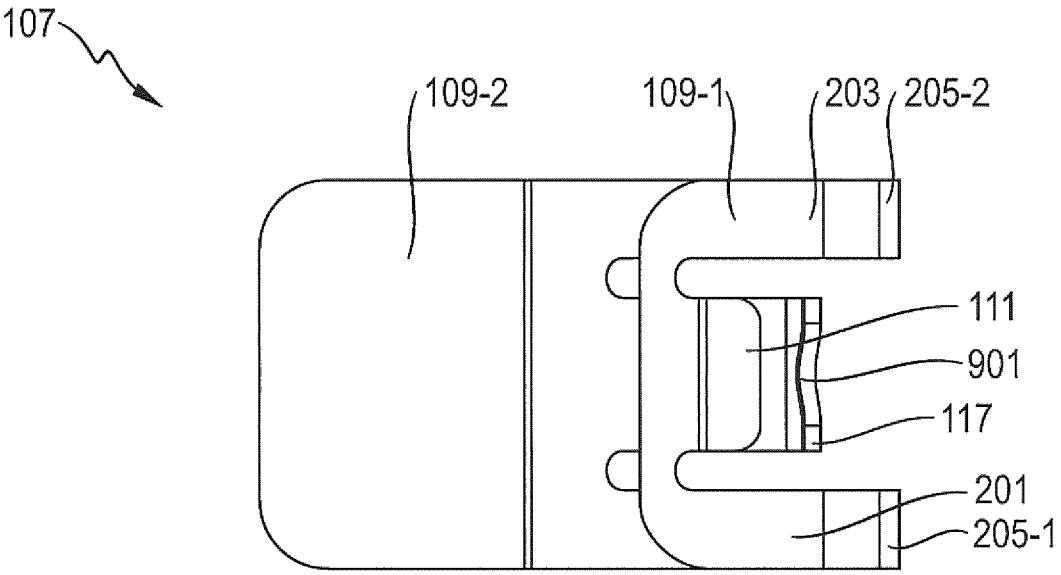
FIG. 11*a*, 11*b*, 11*c* show a bracket-shaped clamping spring in one example.
Figure 11B:
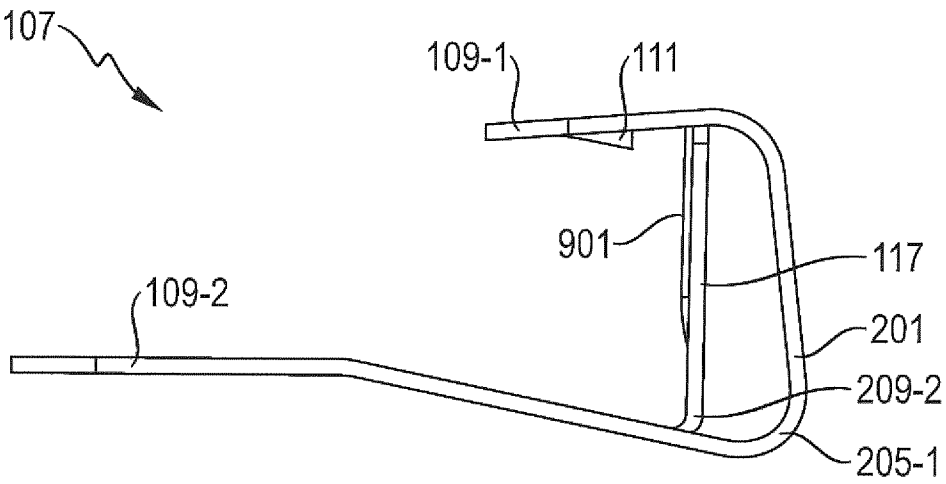

FIG. 11*b* shows a schematic profile view of the bracket-shaped clamping spring 107 according to the example shown in FIG. 11*a*. With the curvature 901, a contact surface of the connecting plate 117 on the armature end face or on the yoke end face can be reduced.

Furthermore, the connecting plate 117 can be applied with a spring tension via the bending section 209-2 in order to press the end face against the armature and/or the yoke. With a reduction in the contact surface, a contact pressure can be increased accordingly with the same contact pressure of the connecting plate 117 against the armature and/or the yoke.

Furthermore, the curvature 901 can form a mounting point for a connection of the bracket-shaped clamping spring 107 to the yoke and/or the armature. For example, the bulge 901 can serve as a guide for a welding device and/or to accommodate a welding means.

Figure 11C:
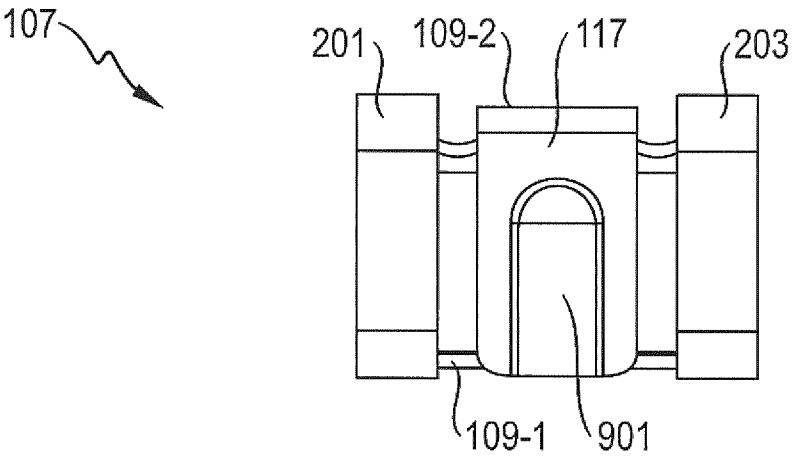

FIG. 11*c* shows a schematic frontal view of the bracket-shaped clamping spring 107 according to the example shown in FIG. 11*a*. The curvature 901 has a semicircular termination in the direction of the second clamping limb 109-2, which delimits the curvature 901. The bracket-shaped clamping spring 107 can in particular be an armature bearing spring.

LIST OF REFERENCE SIGNS

100 relay
101 armature
103 yoke
105 receiving depression
107 bracket-shaped spring clip
109-1 first clamp limb
109-2 second clamp limb
111 angled tab
113 recess
115 web
117 connecting plate
119 armature end face
121 yoke end face

123 recording depth
125 surface
127 clamping direction
129 yoke support surface
201 spring clip
203 further spring clip
205-1 spring bending section
205-2 spring bending section
207-1 spring bending section
207-2 spring bending section
209-1 bending section
209-2 bending section
301 depression
303 yoke limbs
305 contact surface
401 electromagnetic coil
403 coil depth
501 plate-shaped yoke support section
601 relay housing
901 curvature

What is claimed is:

1. A relay, comprising:

an armature;

a yoke configured to be electromagnetically coupled to the armature, wherein the armature lies at least partially flat on the yoke, wherein a receiving depression is partly formed in the armature; and a bracket-shaped clamping spring which surrounds the armature and the yoke on an end face such that the armature is fixed on the yoke, wherein the bracket-shaped clamping spring has a first clamping limb which is arranged in the receiving depression and a second clamping limb which lies on the yoke, wherein the first clamping limb has an angled tab which engages elastically into a recess formed in the receiving depression of the armature.

2. The relay according to claim 1, wherein the armature has a web which at least partially bridges the recess or ends flush with the receiving depression.

3. The relay according to claim 1, wherein the bracket-shaped clamping spring comprises a connecting plate which connects the first clamping limb to the second clamping limb, and wherein the connecting plate lies on one or more of: an armature end face or a yoke end face.

4. The relay according to claim 1, wherein a receiving depth of the receiving depression is at least equal to or greater than a structural depth of the first clamping limb arranged in the receiving depression such that the bracket-shaped clamping spring is arranged on an armature side below a surface of the armature.

5. The relay according to claim 1, wherein the bracket-shaped clamping spring has a clamping direction which, upon electromagnetic activation of the yoke is aligned parallel to a direction of movement of the armature or encloses an acute angle with the direction of movement of the armature, and wherein the first clamping limb and the second clamping limb are at least partially aligned perpendicular to the clamping direction.

6. The relay according to claim 1, wherein the bracket-shaped clamping spring has a spring force which, when the bracket-shaped clamping spring is deflected, is proportional to a deflection distance of the bracket-shaped clamping spring, and wherein the bracket-shaped clamping spring is configured to prevent a relative movement of the armature without electromagnetic activation of the yoke.

7. The relay according to claim 1, wherein the angled tab is adapted to cause a compressive force on the armature and the second clamping limb via engagement in the recess, wherein the compressive force is transmitted on the second clamping limb via a bearing surface of the armature, wherein the bearing surface of the armature lies on the yoke, and a further transmission of the compressive force is via a yoke support surface of the second clamping limb, the yoke lies on the yoke support surface of the second clamping limb.

8. The relay according to claim 1, wherein the second clamping limb comprises a pre-tension acting in a direction of the yoke such that the second clamping limb presses against the yoke via the pre-tension.

9. The relay according to claim 1, wherein the bracket-shaped clamping spring is formed in one piece.

10. The relay according to claim 1, wherein the bracket-shaped clamping spring has a spring clip which is formed at the angled tab and at least partially lies on the yoke, and wherein the spring clip is adapted to act on the yoke with a spring force acting in a direction of the armature.

11. The relay according to claim 10, wherein the spring clip of the first clamping limb, the second clamping limb, an armature end face, and a yoke end face are physically separated.

12. The relay according to claim 10, wherein the bracket-shaped clamping spring has a further spring clip which is formed at the angled tab and is at least partially arranged at a distance from the first clamping limb or the second clamping limb.

13. The relay according to claim 10, wherein the spring clip is connected with the second clamping limb on the yoke side, in order to form a common flat surface of the spring clip and the second clamping limb, wherein the common flat surface of the spring clip lies on the yoke.

14. The relay according to claim 10, wherein the spring clip is arranged at least partially at an angle to the receiving depression or the yoke to increase a contact pressure with which the spring clip acts on the receiving depression or a yoke support surface, and wherein an overall height of the angled the spring clip in the receiving depression is less than or equal to a receiving depth of the receiving depression.

15. The relay according to claim 10, wherein the spring clip is shaped in a U-shape with two spring bending sections, and wherein the two spring bending sections have a smaller curvature than respective bending sections formed at the first clamping limb and the second clamping limb.

16. The relay according to claim 1, wherein the bracket-shaped clamping spring has a curved connecting plate formed at the second clamping limb, and wherein the curved connecting plate has a curvature which lies at a convex contact surface on an armature end face or on a yoke end face.

17. The relay according to claim 16, wherein the curved connecting plate is welded to the yoke.

* * * * *